United States Patent [19]
Engel et al.
[11] 4,352,314
[45] Oct. 5, 1982

[54] DEVICE FOR RELEASABLY SECURING A COUPLING HEAD TO AN EXTERNAL LOAD MOUNTED ON AN AIRCRAFT

[75] Inventors: Herbert Engel, Munich; Thomas Hähnel, Ottobrunn, both of Fed. Rep. of Germany

[73] Assignee: Messerschmitt-Bölkow-Blohm GmbH, Munich, Fed. Rep. of Germany

[21] Appl. No.: 48,737

[22] Filed: Jun. 15, 1979

[30] Foreign Application Priority Data

Jun. 24, 1978 [DE] Fed. Rep. of Germany ..... 2827781

[51] Int. Cl.[3] ..... F41F 5/02; B64D 1/04
[52] U.S. Cl. ..... 89/1.5 F; 244/137 R; 294/83 AE
[58] Field of Search ..... 89/1.5 F, 1.5 G, 1 B; 294/83 AE; 244/137 R

[56] References Cited

U.S. PATENT DOCUMENTS

| | | | |
|---|---|---|---|
| 2,489,984 | 11/1949 | Shoemaker | 244/137 R |
| 2,883,910 | 4/1959 | Nessler | 294/83 AE X |
| 2,888,294 | 5/1959 | Savarieau | 102/4 X |
| 3,053,131 | 9/1962 | Stott | 244/137 R X |
| 3,200,706 | 8/1965 | Kinard | 89/1.5 F X |
| 3,967,529 | 7/1976 | Ingle et al. | 89/1.5 G X |

*Primary Examiner*—David H. Brown
*Attorney, Agent, or Firm*—Toren, McGeady & Stanger

[57] ABSTRACT

In securing a missile to an aircraft, a socket-like recess is formed in the missile housing, a coupling head is releasably secured within the recess by a device including releasable locking members. In addition, an explosive charge is located in the device or the coupling head for displacing the coupling head out of the socket-like recess in the housing when the locking members have been disengaged from the coupling head.

8 Claims, 7 Drawing Figures

DEVICE FOR RELEASABLY SECURING A COUPLING HEAD TO AN EXTERNAL LOAD MOUNTED ON AN AIRCRAFT

SUMMARY OF THE INVENTION

The invention is directed to a device for releasaby securing a coupling head in an external load, such as a missile, which is mounted on an aircraft or similar structure.

In missiles of all type, the members necessary for coupling a missile to a mounting structure, such as an aircraft or the like, have a negative effect on the aerodynamic properties of the missile. Herein, the device for securing a missile to a mounting structure is called a coupling head.

Accordingly, in the past it has been known to provide the coupling head with aerodynamic fairing. In addition, it has also been known to provide a recessed portion in the missile and to design this portion so that it can be closed after the missile is separated from the mounting structure.

U.S. Pat. No. 2,888,294 describes a known coupling head. A cylinder rigidly mechanically connected to the outer skin of the aircraft contains a piston displaceable via an explosive charge. When the explosive charge is ignited, a clamp ball coupling of known design, such as disclosed in German Patent No. 536,788. is opened by the displacement of the piston and a container attached by the coupling to the aircraft is released during flight.

Therefore, it is the primary object of the present invention to provide coupling heads which have no influence on the aerodynamic properties of the missile when the missile has been released from its mounting structure. In accordance with the invention, however, the rigid mechanical connection to the mounting structure does not suffer. Furthermore, the device embodying the present invention is such that very small structural sizes are possible so that it is unnecessary to close any openings which are formed in the missile body.

In accordance with the present invention, a coupling head is received in a socket-like recess formed in the missile housing and a key bolt extending laterally into the recess secures the coupling head within the missile. The key bolt is spring-biased into engagement with the coupling head. A mechanical or electro-magnetic element or an explosive charge can be used for overcoming the biasing action of the spring and unlocking the coupling head from the missile so that the coupling head can be ejected by an explosive charge.

To keep the tolerances of the socket-like recess and the coupling head within limits and to afford an adequate buildup of ejection pressure, the coupling head includes a sealing ring so that it can be held in a gas-tight manner within the socket.

The coupling head is secured within the recess so that it cannot rotate by providing a keyway in the coupling head for engagement by a locking key located in the bottom of the socket-like recess.

In one embodiment of the invention, an explosive charge is included within the key bolt and a locking head is attached to the key bolt over a predetermined breaking part. An open or hollow space is provided within the coupling head for receiving the head of the key bolt after it is broken off by the explosive charge. The hollow space receives the propulsion gases from the explosive charge so that adequate ejection pressure is developed for displacing the coupling head out of the missile.

To prevent the separated head of the key bolt from rebounding back to its original position, the head of the key bolt facing into the hollow space is provided with an inclined surface.

Instead of locking the coupling head on one side only, it is also advantageous if the locking action is provided by two diametrically disposed spring-loaded key bolts which can be disengaged from the locking position by the force generated when an explosive charge is detonated within the coupling head.

To prevent the airplane from being struck by the coupling head during unusual flying conditions, an aerodynamic braking device is provided on the coupling head. A simple but effective embodiment of such a braking device includes a conical shield which can be opened in the manner of an umbrella. The shield includes rod-like wires which are fastened to the coupling head by another wire fitted into a groove formed in the coupling head.

In such an aerodynamic braking device, a slidable ring located on the coupling head is very helpful, since it can serve as a sealing member before ejection and then effect the opening of the shield during ejection.

In another embodiment of the invention a parachute can be attached to the coupling head and positioned between the end of the coupling head and the closed bottom of the socket-like recess.

A preferred arrangement of the present invention involves a system including two laterally spaced coupling heads. These two coupling heads are secured within recesses in the housing by a single key bolt which can be released by a mechanical or electromagnetic device or by an explosive charge.

Finally, the known clamping ball coupling can be advantageously combined with the subject matter of the invention.

In addition to the ability to eject the coupling head, another considerable advantage of the present invention is that the construction features of the missile are not affected. The structure of the present invention can be incorporated into the missile without causing any problems, because of the small dimensions involved. In addition, the present invention is particularly useful for supersonic missiles, since it is unnecessary to construct cumbersome and expensive mechanisms.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention. DR

DETAIL DESCRIPTION OF THE INVENTION

Figure 1:
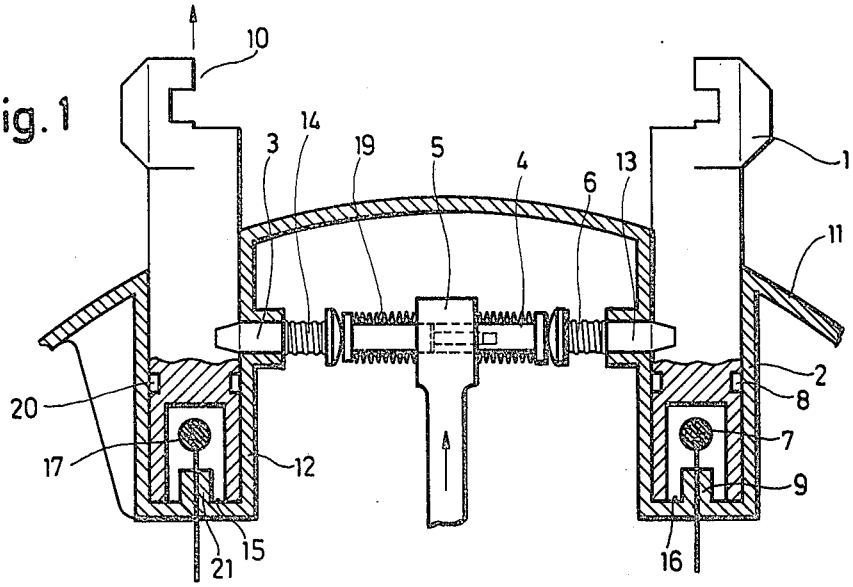
FIG. 1 is a partial sectional view of a missile containing two coupling heads and incorporating the present invention.
Figure 1A:
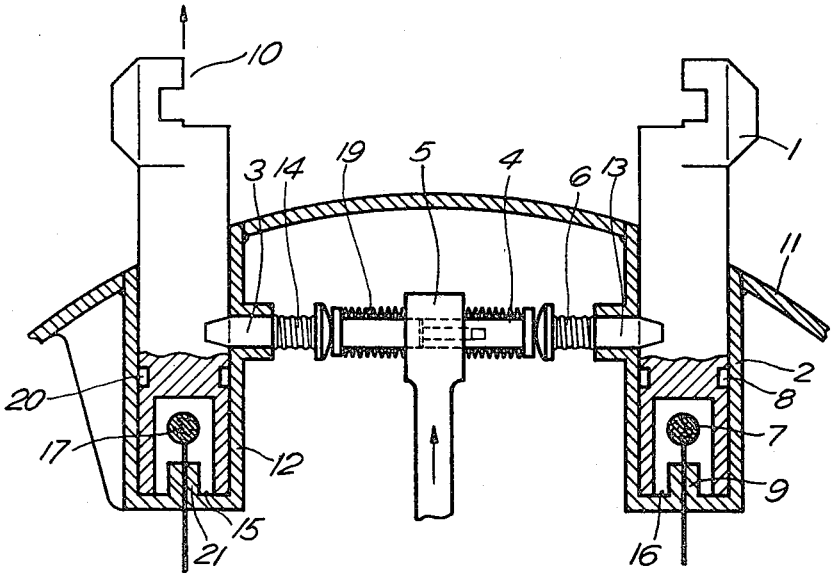
FIG. 1A is a partial sectional view similar to FIG. 1, but showing the socket-like recesses as separate components.

In FIG. 1 a pair of coupling heads 1, 10 are spaced laterally apart in a missile. A portion of the outer surface 11 is shown, though the missile is not shown in detail, and the outer surface or housing 11 is shaped to form a pair of socket-like recesses or bushings 2, 12 each arranged to receive one of the coupling heads 1, 10. While the socket-like recesses are illustrated in FIG. 1 as being formed integrally with the missile housing 11 it would also be possible to form the recesses as separate structural components and attach them to the missile housing by screw connections or the like. In FIG. 1A the socket-like recesses are shown as separate structural components connected to the missile housing 11 by weldments. The rest of the structure in FIG. 1A is the same as in FIG. 1. The cylindrically shaped configuration of the recesses provide a good holding arrangement for the coupling heads in the missile. Each recess is open at the outer surface of the missile and has a closed bottom. A key 9, 21 is located at the closed bottom of each of the recesses 2, 12 for engagement in corresponding keyways located in the inner ends of the coupling heads. The engagement of the keys 9, 21 in the keyways in the coupling heads secures the coupling heads against rotation within the recesses. As illustrated in FIG. 1, the coupling heads 1, 10 are secured within the recesses 2, 12 by key bolts 3, 13 which extend, transversely of the axes of the recesses, into the coupling heads. Each key bolt is pretensioned by means of a spring 6, 14 for movement out of the recess. An explosive charge 7, 17 is located within the inner end of each coupling head or within the corresponding recess. An element 5 extends between the two key bolts 3, 13 and includes springs 4, 19 effecting a biasing action against the key bolts maintaining them in position within the recesses in the missile housing 11. Element 5 is secured to the mechanism extending between the key bolts 3, 13.

In releasing the coupling heads 1, 10 the following action takes place: Initially the element 5 is removed releasing the key bolts 3, 13 from engagement with the coupling heads and the springs 6, 14 bias the key bolts out of the recesses 2, 12. After the key bolts 3, 13 are released, the explosive charges 7, 17 are ignited and the coupling heads are ejected out of the recesses. To avoid any pressure losses in the propulsive gases generated when the explosive charges are ignited, sealing rings 8, 20 are fitted into the coupling heads and bear against the surfaces of the recesses so that the open spaces within the coupling head are maintained gas-tight.

Figure 2:
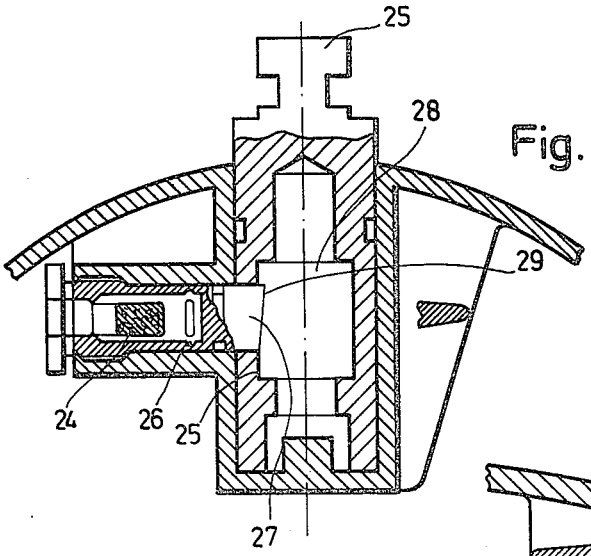
FIG. 2 illustrates a concentrically arranged coupling head.

In FIG. 2 a concentric coupling head 25 is shown constructed on the same basis as described above.

In this embodiment, however, there is the difference that the explosive charge 24 performs a dual function. In this arrangement, the explosive charge 24 is located within the key bolt 25. First, after the detonation of the charge 24, the action of the explosive gases generated causes the head 27 of the key bolt to shear off at the predetermined breaking line 26. As a result, the head is displaced into an interior hollow space 28 in the coupling head arranged to receive the head. This hollow space 28 is dimensioned so that the force developed by the detonation of the explosive charge is sufficient to act as the medium for ejecting the coupling head out of the recess in the missile housing.

As can be seen in FIG. 2, the surface 29 on the head 27 facing into the hollow space 28 is located in a plane inclined at an oblique angle to the axis of the recess. The inclined surface 29 prevents any rebound of the head 27 back to its original position.

Figure 3:
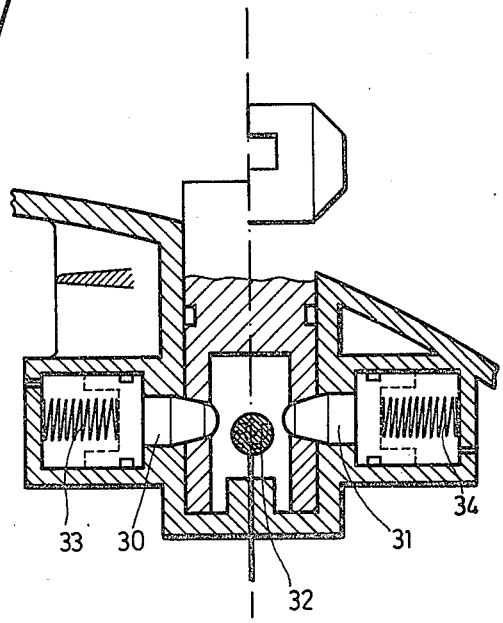
FIG. 3 shows a laterally arranged coupling head with radially arranged locking key bolts.

In FIG. 3 a lateral coupling head is displayed held in the recess in the missile housing by a pair of diametrically opposed radially extending key bolts 30, 31. It will be appreciated that a concentric coupling head could also be used with the same key bolt arrangement. Depending on the locking requirements, any number of key bolts can be utilized. The key bolts 30, 31 are pressed into locking engagement with the coupling head by the springs 33, 34. The head ends of the key bolts 30, 31 extend into an open space within the coupling head containing an explosive charge 32. When the charge 32 is ignited the bolts are displaced radially outwardly against the force of the springs 33, 34 and the coupling head is released so that it can be ejected by the explosive gases developed by the charge 32.

Figure 4:
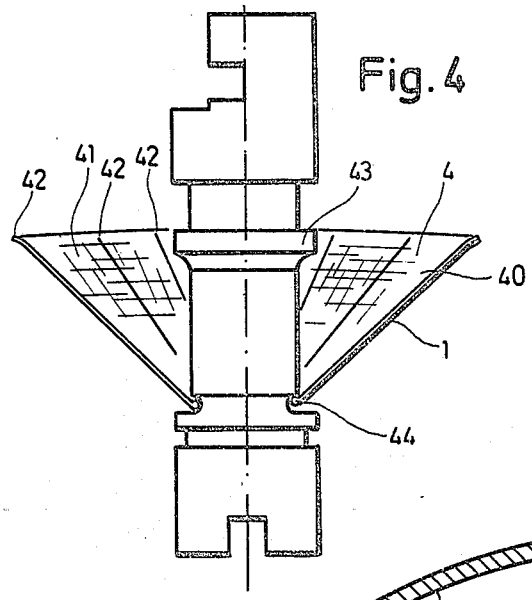
FIG. 4 exhibits an ejected coupling head with an opened braking shield.

In FIG. 4 a coupling head appears displaced out of the missile housing and with an aerodynamic braking device 40 shown in the open position. This braking device consists of a shield 41 which can be opened in the manner of an umbrella. In its closed position, while the coupling head is held in the missile housing, rod-like wires 42 in the shield are pressed against the surface of the coupling head and the ring 43 is displaced upwardly from the position shown in FIG. 4. At the lower end of the shield 41, a wire 44 seats in a groove in the coupling head and holds the shield together. After the coupling head is ejected, the ring 43 which previously has acted as a sealing member, is moved downwardly and presses the rod-like wires apart and places the shield in the open position.

Figure 5:
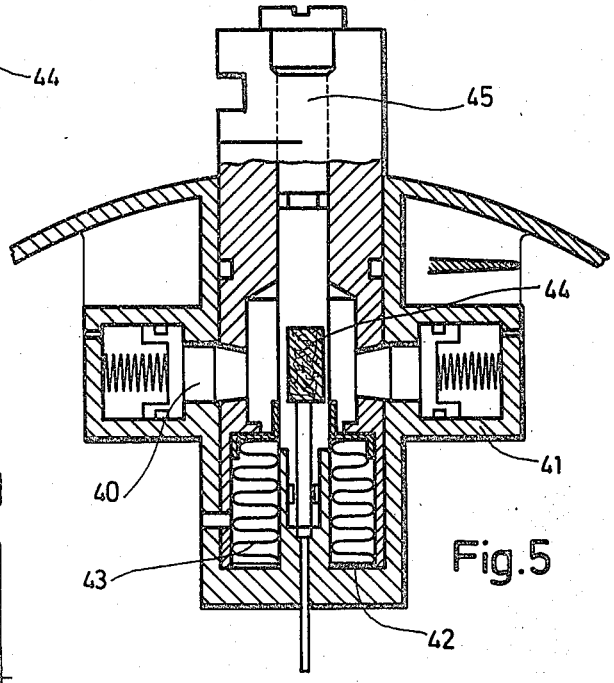
FIG. 5 illustrates a sectional view of a missile with a coupling head and parachute inserted into the missile housing, and with an explosive charge which can be screwed into the coupling head.

In FIG. 5 a concentric coupling head is shown with radially arranged key bolts 40, 41 disposed on opposite sides of the coupling head. The coupling head extends downwardly into the bottom 42 of the housing recess and the combination of the inner end of the coupling head and the bottom form an open space. A parachute 43 is positoned within the open space. The parachute is connected to the coupling head and, in addition, it is adhesively jointed to the bottom 42 of the recess in the missile housing. The adhesive connection of the parachute 43 to the bottom of the recess separates after an appropriate forced opening of the parachute.

In addition, an explosive charge 44 is located within a hollow space extending axially through the coupling head. The charge can be inserted into the coupling head through a screw connection 45. As a result, when the missile is being stored, it is not necessary to incorporate the explosive charge, accordingly, it is easy to maintain the missile disarmed or to deactivate it.

Figure 6:
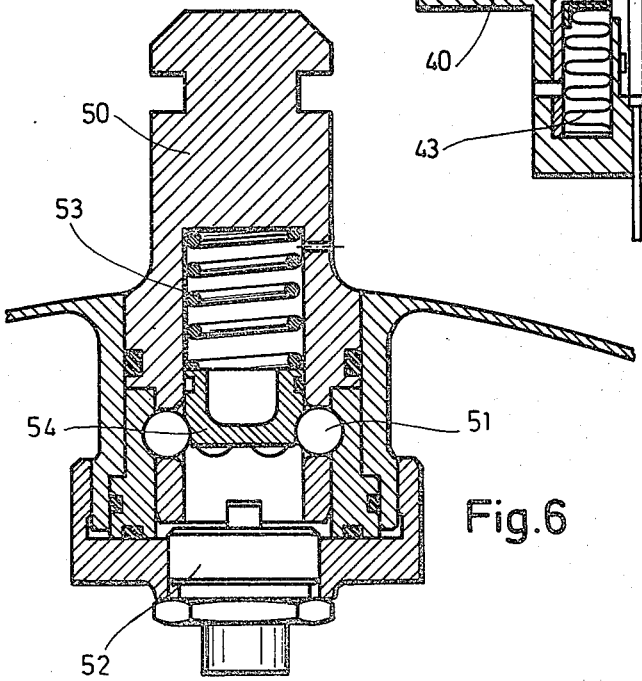
FIG. 6 is a sectional view of a missile with a clamping ball coupling securing the coupling head within the missile.

FIG. 6 illustrates an embodiment of a releasable concentric coupling head 50 secured by a clamping ball coupling 51 within a recess formed in the missile housing. An explosive charge 52 is positioned within a member forming the bottom of the recess in the housing. Immediately above the explosive charge 52, the coupling head is shaped to provide an open space. In the locked position, as shown, a spring 53 presses downwardly against a piston 54 and the piston presses outwardly against the balls of the coupling 51 providing the known coupling effect.

After the explosive charge is detonated the pressure build-up within the open space above the charge presses upwardly against the piston 54 displacing it so that the coupling with the missile housing is broken. As the pressure continues to build up, the coupling head, now released from the missile housing, is ejected out of the housing recess.

In the various embodiments described above, the releasing action can be effected from the aircraft or through a delay circuit in the missile or through other suitable means.

While specific embodiments of the invention have been shown and described in detail to illustrate the application of the inventive principles, it will be understood that the invention may be embodied otherwise without departing from such principles.

We claim:

1. Device for securing external loads, such as missiles, on aircraft or similar mounting members, comprising a housing, a coupling head releasably securable to said housing, wherein the improvement comprises first means forming a socket-like recess extending inwardly from said housing and open on the outer surface of said housing for receiving said coupling head, second means mounted within said housing for releasably securing said coupling head in said socket-like recess, third means in operative engagement with said second means for releasing said second means from securing said coupling head in said socket-like recess and fourth means independent from said third means for ejecting said coupling head from said socket-like recess when said second means are released from secured engagement with said coupling head.

2. Device, as set forth in claim 1, wherein said first means comprises a cylindrically shaped container located in said housing open at the surface of said housing and closed at the end thereof spaced inwardly from the surface of said housing and the interior of said container forming said socket-like recess.

3. Device, as set forth in claim 2, wherein said container is formed integrally with said housing.

4. Device, as set forth in claim 2, wherein said container is a separate component and is attached to said housing.

5. Device, as set forth in claim 2, including a sealing ring positioned in and extending around said coupling head, said sealing ring provides a gas-tight seal between said coupling head and the interior surface of said container forming said socket-like recess.

6. Device, as set forth in claim 2, wherein said container has a locking key formed in the closed end thereof, said locking key projecting into said recess, the end of said coupling head located in juxtaposition to said locking key when it is inserted into said container has a keyway into which said locking key seats so that said coupling head is secured against rotation about the axis of said container which axis extends through the open end and closed end of said container.

7. Device, as set forth in claim 2, wherein a pair of said containers are located in laterally spaced relation in said housing, said second means comprises a pair of key bolts each extending into one of said containers for releasably securing said coupling head therein, said third means comprises springs for biasing said key bolts out of engagement with said coupling heads, and a member extending between and engaging said key bolts in securing engagement with said coupling heads and said member being displaceable out of retaining engagement with said key bolts so that said key bolts are displaced from engagement with said coupling heads by said springs.

8. Device, as set forth in claim 7, wherein said fourth means comprises an explosive charge located within each coupling head for ejecting said coupling heads out of said containers when said key bolts are displaced from securing engagement with said coupling heads.

* * * * *